US006972279B2

(12) United States Patent
Deak et al.

(10) Patent No.: US 6,972,279 B2
(45) Date of Patent: Dec. 6, 2005

(54) SILICONE POLYMERS FOR LIPOPHILIC FLUID SYSTEMS

(75) Inventors: John Christopher Deak, Clarks Summit, PA (US); Eugene Paul Gosselink, Cincinnati, OH (US); Randall Thomas Reilman, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 557 days.

(21) Appl. No.: 10/238,248

(22) Filed: Sep. 10, 2002

(65) Prior Publication Data

US 2003/0104968 A1 Jun. 5, 2003

Related U.S. Application Data

(60) Provisional application No. 60/318,455, filed on Sep. 10, 2001.

(51) Int. Cl.[7] ..... C11D 3/38; C11D 17/04

(52) U.S. Cl. ..... 510/466; 510/285

(58) Field of Search ..... 510/285, 466

(56) References Cited

U.S. PATENT DOCUMENTS

| | | | |
|---|---|---|---|
| 4,102,824 | A | 7/1978 | Mizutani et al. |
| 4,639,321 | A | 1/1987 | Barrat et al. |
| 4,685,930 | A | 8/1987 | Kasprzak et al. |
| 4,708,807 | A | 11/1987 | Kemerer et al. |
| 5,057,240 | A | 10/1991 | Madore et al. |
| 5,705,562 | A | 1/1998 | Hill et al. |
| 5,707,613 | A | 1/1998 | Hill et al. |
| 5,741,765 | A | 4/1998 | Leach et al. |
| 5,865,852 | A | 2/1999 | Berndt et al. |
| 5,876,510 | A | 3/1999 | Kuemin et al. |
| 5,888,250 | A | 3/1999 | Hayday et al. |
| 5,942,007 | A | 8/1999 | Berndt et al. |
| 5,977,040 | A | 11/1999 | Inada et al. |
| 5,985,810 | A | 11/1999 | Inada et al. |
| 6,013,683 | A | 1/2000 | Hill et al. |
| 6,042,617 | A | 3/2000 | Berndt et al. |
| 6,042,618 | A | 3/2000 | Berndt et al. |
| 6,056,789 | A | 5/2000 | Berndt et al. |
| 6,059,845 | A | 5/2000 | Berndt et al. |
| 6,060,546 | A | 5/2000 | Powell et al. |
| 6,063,135 | A | 5/2000 | Berndt et al. |
| 6,136,766 | A | 10/2000 | Inada et al. |
| 6,156,074 | A | 12/2000 | Hayday et al. |
| 6,177,399 | B1 | 1/2001 | Mei et al. |
| 6,258,130 | B1 | 7/2001 | Murphy et al. |
| 6,273,919 | B1 | 8/2001 | Hayday et al. |
| 6,309,425 | B1 | 10/2001 | Murphy et al. |
| 6,310,029 | B1 | 10/2001 | Kilgour et al. |
| 6,313,079 | B1 | 11/2001 | Murphy et al. |
| 6,368,359 | B1 | 4/2002 | Perry et al. |
| 2001/0020308 | A1 | 9/2001 | Murphy et al. |
| 2001/0034912 | A1 | 11/2001 | Kilgour et al. |
| 2002/0004953 | A1 | 1/2002 | Perry et al. |
| 2002/0115582 | A1 | 8/2002 | Perry et al. |
| 2002/0174493 | A1 | 11/2002 | Perry et al. |

FOREIGN PATENT DOCUMENTS

| | | | |
|---|---|---|---|
| DE | 37 39 711 | A1 | 6/1989 |
| EP | 0182 583 | A2 | 5/1986 |
| EP | 0 363 346 | A2 | 4/1990 |
| EP | 0 375 028 | A2 | 6/1990 |
| EP | 0473 795 | A1 | 3/1992 |
| EP | 0982 023 | A2 | 3/2000 |
| EP | 1 041 189 | A1 | 10/2000 |
| EP | 1 043 443 | A1 | 10/2000 |
| EP | 1092 803 | A1 | 4/2001 |
| EP | 1 201 817 | A1 | 5/2002 |
| JP | 2000-290689 | | 10/2000 |
| WO | WO 98/39401 | | 9/1998 |
| WO | WO 00/04221 | | 1/2000 |
| WO | WO 00/04222 | | 1/2000 |
| WO | WO 00/63340 | | 10/2000 |
| WO | WO 01/40567 | A1 | 6/2001 |
| WO | WO 01/94678 | A1 | 12/2001 |
| WO | WO 01/94681 | A1 | 12/2001 |
| WO | WO 01/94684 | A1 | 12/2001 |
| WO | WO 02/97024 | | 5/2002 |
| WO | WO 02/46517 | A1 | 6/2002 |
| WO | WO 02/48447 | A1 | 6/2002 |
| WO | WO 02/50366 | A1 | 6/2002 |
| WO | WO 02/77356 | A1 | 10/2002 |

*Primary Examiner*—Yogendra N. Gupta
*Assistant Examiner*—John M Petruncio
(74) *Attorney, Agent, or Firm*—Caroline Wei-Berk; Kim W. Zerby; Steve W. Miller

(57) ABSTRACT

A composition containing a silicone-containing polymer for cleaning fabric articles, especially articles of clothing, linen and drapery, with lipophilic fluid provides improved cleaning of soils while providing excellent garment care, especially for articles sensitive to water.

8 Claims, No Drawings

SILICONE POLYMERS FOR LIPOPHILIC FLUID SYSTEMS

RELATED APPLICATIONS

This application claims priority to U.S. Provisional Application Ser. No. 60/318,455 filed Sep. 10, 2001.

FIELD OF THE INVENTION

The present invention relates to compositions for cleaning fabric articles, especially articles of clothing, linen and drapery, wherein the compositions provide improved cleaning of soils while providing excellent garment care for articles sensitive to water.

BACKGROUND OF THE INVENTION

For the cleaning of fabric articles consumers currently have the choice of conventional laundry cleaning or dry cleaning.

Conventional laundry cleaning is carried out with relatively large amounts of water, typically in a washing machine at the consumer's home, or in a dedicated place such as a coin laundry. Although washing machines and laundry detergents have become quite sophisticated, the conventional laundry process still exposes the fabric articles to a risk of dye transfer and shrinkage. Significant portions of fabric articles used by consumers are not suitable for cleaning in a conventional laundry process. Even fabric articles that are considered "washing machine safe" frequently come out of the laundry process badly wrinkled and require ironing.

Dry cleaning processes rely on non-aqueous solvents for cleaning. By avoiding water these processes minimize the risk of shrinkage and wrinkling, however, cleaning of soils, particularly water-based and alcohol-based soils is very limited with these processes. Typically, the dry-cleaner removes such soils by hand prior to the dry-cleaning process. These methods are complex, requiring a wide range of compositions to address the variety of stains encountered, very labor intensive and often result in some localized damage to the treated article.

Accordingly there is an unmet need, in commercial laundry, in dry-cleaning and in the home, for cleaning compositions, which simultaneously provide acceptable cleaning across a variety of soils while remaining safe for a wide range of fabric articles.

Silicone-containing polymers functionalized with hydrogen bonding substituent groups selected from the group consisting of polyols, polyamines, and/or alkanolamines aid soil removal for washing processes using lipophilic fluids, especially decamethylcyclopentasiloxane (known as "$D_5$"), and formulation of products for use therein.

SUMMARY OF THE INVENTION

The present invention provides compositions which exhibit improved cleaning of soils from fabric articles, while maintaining excellent fabric care properties. The cleaning compositions comprise silicone-containing polymers functionalized with hydrogen bonding substituent groups selected from the group consisting of polyols, polyamines, alkanolamines, and combinations thereof. Optionally, the silicone-containing polymers may be functionalized with additional polar substitutent groups selected from the group of amines, monoalcohols, polyalkylene oxides, amides, and combinations thereof.

The features and advantages of such cleaning compositions will become apparent to those of ordinary skill in the art from a reading of the following detailed description and the appended claims. All percentages, ratios and proportions herein are by weight, unless otherwise specified. All temperatures are in degrees Celsius (°C.) unless otherwise specified. All measurements are in SI units unless otherwise specified. All documents cited are in relevant part, incorporated herein by reference.

DETAILED DESCRIPTION OF THE INVENTION

Definitions:

"Silicone-containing polymer", as used herein, means a silicone-containing backbone for the polymer, identified by siloxane monomeric units such as polydimethylsiloxane ("PDMS"), which polymer is capable of being functionalized with polyol, polyamine, and/or alkanolamine substituents and optionally with amine, monoalcohol, polyalkylene oxide, and/or amide substitutents. An example structure of a suitable siloxane backbone is:

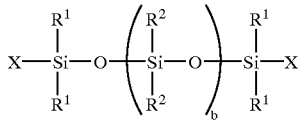

where X is H, a hydroxyl or a monovalent hydrocarbon group, and $R^1$ and $R^2$ are independently H or a monovalent hydrocarbon group. Such structures are abbreviated as $MD_bM$ where $M=XR^1_2SiO_{0.5}$—, and $D=—O_{0.5}Si(R^2)_2O_{0.5}$—. One or more primes, such as D' or M', is used to indicate one or more of the $R^1$ or $R^2$ groups is substituted for a non-siliconcontaining organic group R.

The unsubstituted polysiloxane segments of the polymers of the invention comprise units, $—SiR^2_2O—$ in which $R^1$ and $R^2$ are selected from the group of C1–C22 alkyl, aryl, arylalkyl, fluoroalkyl and combinations thereof. The preferred $R^1$ and $R^2$ groups are methyl.

These polymers include copolymers of functionalized monomeric units with non-functionalized monomeric units (i.e., not all the monomeric units are functionalized) and polymers made up of siloxane monomeric units and non-siloxane monomeric units. Block, random, star, graft, and other types of copolymers are also included.

"Functionalized", as used herein, means the indicated substituent groups are chemically bonded to the silicone-containing polymer.

A "functional unit", as used herein, means one substituent group used to functionalize the silicone-containing polymer. The silicone-containing polymers useful for the present invention may contain only a single functional unit, but may also contain two or even many functional units per polymer.

"Polyol substituents", as used herein, means a functional unit containing more than one hydroxyl group per functional unit.

"Polyamine substituents", as used herein, means a functional unit containing more than one amino group per functional unit. Amino groups useful herein include unsubstituted amino groups as well as mono and di-substituted amino groups (typically the mono and di-substitution is with a C1–C6 alkyl moiety).

"Alkanolamine substituents", as used herein, means a functional unit containing at least one hydroxyl group and at least one amino group per functional unit.

"Combinations thereof" with respect to the non-optional functional units, as used herein, means the silicone-containing polymer is functionalized with at least one polyol substituent and at least one polyamine substituent, or is functionalized with at least one polyol substituent and at least one alkanolamine substituent, or is functionalized with at least one polyamine substituent and at least one alkanolamine substituent. With respect to the optional functional units, the term "combinations thereof" means that in addition to one or more non-optional functional unit, the silicone-containing polymer may be functionalized with any combination of optional units selected from monoamines, monoalcohols, polyalkylene oxides, and amides.

The term "fabric article" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any nonaqueous fluid capable of removing sebum, as described in more detail herein below.

The term "cleaning composition" and/or "treating composition" used herein is intended to mean any lipophilic fluid-containing composition that comes into direct contact with fabric articles to be cleaned. It should be understood that the term encompasses uses other than cleaning, such as conditioning and sizing. Furthermore, optional cleaning adjuncts such as surfactants, bleaches, and the like may be added to the "cleaning composition". That is, cleaning adjuncts in addition to the silicone-containing polymer may be optionally combined with the lipophilic fluid. These optional cleaning adjuncts are described in more detail herein below. Such cleaning adjuncts may be present in the cleaning compositions of the present invention at a level of from 0.001% to about 10% by weight of the cleaning composition.

The term "soil" means any undesirable substance on a fabric article that is desired to be removed. By the terms "water-based" or "hydrophilic" soils, it is meant that the soil comprised water at the time it first came in contact with the fabric article, that the soil has high water solubility or affinity, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

The term "capable of suspending water in a lipophilic fluid" means that a material is able to suspend, solvate or emulsify water, which is immiscible with the lipophilic fluid, in a way that the water remains visibly suspended, solvated or emulsified when left undisturbed for a period of at least five minutes after initial mixing of the components. In some examples of compositions in accordance with the present invention, the compositions may be colloidal in nature and/or appear milky. In other examples of compositions in accordance with the present invention, the compositions may be transparent.

The term "insoluble in a lipohilic fluid" means that when added to a lipophilic fluid, a material physically separates from the lipophilic fluid (i.e. settle-out, flocculate, float) within 5 minutes after addition, whereas a material that is "soluble in a lipophilic fluid" does not physically separate from the lipophilic fluid within 5 minutes after addition.

The term "consumable detergent composition" means any composition, that when combined with a lipophilic fluid, results in a cleaning composition according to the present invention.

The term "processing aid" refers to any material that renders the consumable detergent composition more suitable for formulation, stability, and/or dilution with a lipophilic fluid to form a cleaning composition in accordance with the present invention.

The term "mixing" as used herein means combining two or more materials (i.e., fluids, more specifically a lipophilic fluid and a consumable detergent composition) in such a way that a homogeneous mixture is formed. Suitable mixing processes are known in the art. Nonlimiting examples of suitable mixing processes include vortex mixing processes and static mixing processes.

Compositions of the Present Invention

The present invention provides compositions which exhibit improved cleaning of soils (i.e., removal and/or reduction of soils) from fabric articles, while maintaining excellent fabric care properties.

Silicone-Containing Polymers

Alkoxylated amine and polyol functionalities have the ability to penetrate and/or dissolve water-soluble and water-based soils. However, these functionalities are typically not soluble in lipohilic fluids such as $D_5$. For improved hydrophilic cleaning, the present invention compositions utilize silicone-containing polymers to which these functionalities are appended onto highly soluble polymers, like polysiloxanes. For solubility in lipophilic fluids, particularly $D_5$, the sum of the dialkylsiloxane, alkylarylsiloxane, diarylsiloxane, and fluoroalkylsiloxane content (silicone content) should be >60% of the mass of the entire polymer. This is calculated from the molecular weight of the siloxane backbone, not including non-silicon containing organic groups that have been substituted for $R^1$, divided by the molecular weight of the entire molecule and multiplied by 100 to express as a percentage. Examples for specific structures are shown in Table 1. In these specific examples, only one of the $R^2$ groups of each D' is substituted for R (i.e. $D'=—O_{0.5}SiR^2RO_{0.5}—$.

TABLE 1

Example structures

| Structure | X | $R^1$, $R^2$ | R | Molecular weight | silicone content |
|---|---|---|---|---|---|
| $MD_{100}D'_{50}M$ | $CH_3$ | $CH_3$ | 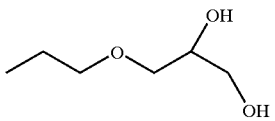 | 17,192.6 | 61% |

TABLE 1-continued

Example structures

| Structure | X | $R^1$, $R^2$ | R | Molecular weight | silicone content |
|---|---|---|---|---|---|
| $MD_{10}D'_5M$ | $CH_3$ | $CH_3$ | 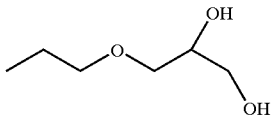 | 1,865.4 | 64% |
| $MD_{10}D'_2M$ | $CH_3$ | $CH_3$ | 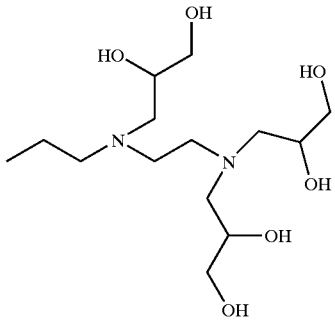 | 1,669.0 | 61% |
| $MD_{200}D'_{10}M$ | $CH_3$ | $CH_3$ | 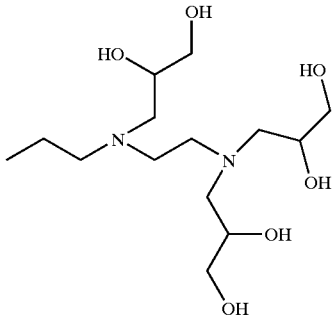 | 18,819.3 | 83% |

These polymers provide a cleaning additive for cleaning (including dry-cleaning) in lipophilic fluids that has the appropriate chemical forces for penetrating or interacting strongly with water-soluble and water-based soils and is highly soluble so that the soil can be suspended in the lipophilic fluid.

The following six structures exemplify preferred silicone-containing polymers useful in the compositions of the present invention:

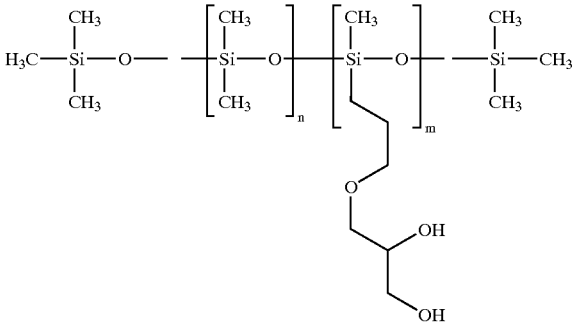

-continued

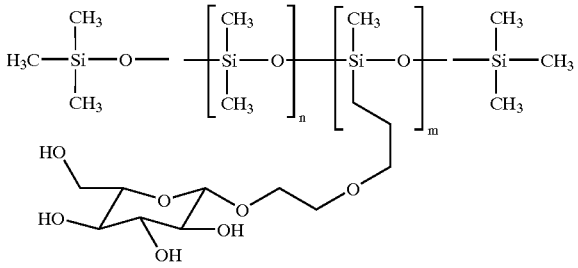

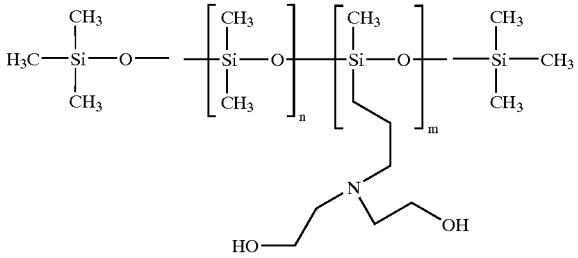

-continued

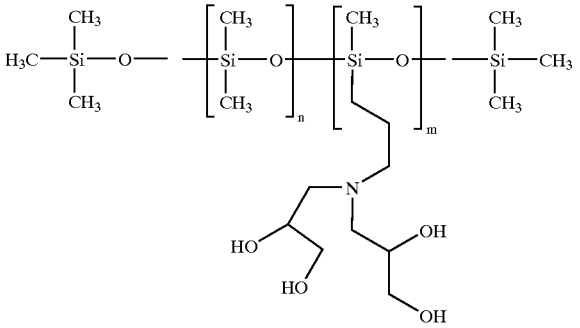

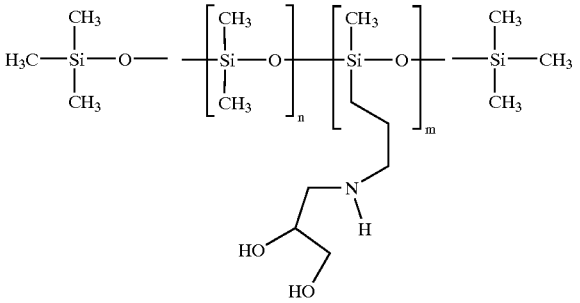

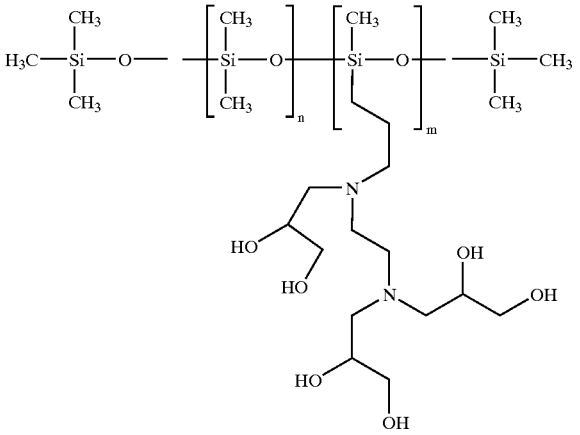

wherein m is from 1 to 100 and n is from 2 to 200, and wherein further m is less than half of n. Preferred molecular weights are in the range of from about 1,000 to about 20,000.

Conveniently, these materials can be made from commercially available polysiloxanes and amino silicones. Although the 100% siloxane backbone is preferred, other organic monomeric units may be included in the silicone-containing polymers. The poly alcohol, polyamine, and alkanolamine appendages may be pendant or terminal (i.e. ABA structure). Pendant ethyleneoxy ("EO"), proplyeneoxy ("PO"), and ethyleneoxy/propyleneoxy ("EO/PO") substitutions are also envisioned in combination with at least one of the non-optional substitutents.

The silicone-containing polymers are present in the cleaning compositions of the present invention at levels from about 0.001% to about 2%, more preferably from about 0.01% to about 1.0%, even more preferably from about 0.02% to about 0.5% by weight of the cleaning composition.

The silicone-containing polymers are present in the consumable detergent compositions of the present invention at levels from about 0.01% to about 10%, more preferably from about 0.05% to about 5%, even more preferably from about 0.1% to about 2.0% by weight of the consumable detergent composition.

SYNTHESIS EXAMPLES

Hydrosilation Adduct of Poly(dimethylsiloxane-co-methylhydrosiloxane), trimethylsilyl terminated polymer and 3-Allyloxy-1,2-propandiol To a 250 ml, single neck, round bottom flask equipped with a magnetic stir bar and water cooled condenser with argon inlet is added 15 grams of Poly(dimethylsiloxane-co-methylhydrosiloxane), trimethylsilyl terminated polymer (containing 4% methylhydrosiloxane, Aldrich product code: 48237-4), 1.06 grams (0.008 moles) of 3-Allyloxy-1,2-propandiol (Aldrich product code: 25173-9), 0.01 grams of $H_2PtCl_6$ (Aldrich product code: 20608-3), 0.05 grams of 2,2,6,6-tetramethyl-4-piperidinol (Aldrich product code: 11574-6) and 50 ml of Toluene ('Baker Analyzed' A.C.S. Reagent). With mixing under argon, reaction mixture is heated at reflux for 2.5 hours then let to cool to room temperature (23° C.). 15 grams of Amberlyst A-21 is added and the mixture heated at 80–90° C. for 15 hours, cooled to room temperature and filtered to recover a clear, pale yellow solution with a small insoluble phase (moisture from Amberlyst). The toluene layer is decanted away from water droplets and concentrated to recover a viscous, dark orange liquid. Proton NMR ($CDCl_3$) shows a resonance at 0.5 ppm representing—$SiCH_2CH_2CH_2OCH_2CH(OH)CH_2OH$, a resonance at 1.6 ppm representing—$SiCH_2CH_2CH_2OCH_2CH(OH)CH_2OH$ and a resonance at 3.43 ppm representing—$SiCH_2CH_2CH_2OCH_2CH(OH)CH_2OH$ and the disappearance of resonances at 5.21 ppm representing $CH_2{=}CHCH_2OCH_2CH(OH)CH_2OH$ and 5.95 ppm representing $CH_2{=}CHCH_2OCH_2CH(OH)CH_2OH$ indicating the methylhydrosiloxane units have reacted with the 3-allyloxy-1,2-propanediol to form the desired product.

Preparation of Glycidol Derivatized Aminopropyl PDMS

To a 250 ml, single neck, round bottom flask equipped with a magnetic stir bar and water cooled condenser with argon inlet is added 15 grams of an aminopropylmethylsiloxane-dimethylsiloxane copolymer (MW=7000–8000 containing 4–5 mole % aminopropylmethylsiloxane from Gelest, Inc., product code: AMS-152), 1.33 grams (0.018 moles) of glycidol (Aldrich, product code: G580-9) and 50 ml of 2-propanol ('Baker Analyzed' A.C.S. Reagent). With mixing under argon, the solution is refluxed for 15 hours then concentrated by evaporation of 2-propanol using rotary evaporator to afford a clear, colorless, viscous liquid. $^{13}C$ NMR ($CDCl_3$) shows resonances at 56.6 ppm and 58.0 ppm for—$SiCH_2CH_2CH_2N(CH_2CH(OH)CH_2OH)_2$ and absences of resonances at 44.2 ppm for—$SiCH_2CH_2CH_2NH_2$ and 51.2 ppm and 51.9 ppm for —$SiCH_2CH_2CH_2NH(CH_2CH(OH)CH_2OH)$ indicating full derivatization of the aminopropyl units with glycidol units.

Lipophilic Fluid

The lipophilic fluid herein is one having a liquid phase present under operating conditions of a fabric/leather article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg. C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamines while unsuitable for use as lipophilic fluid may be present as one of many possible adjuncts present in the lipophilic fluid-containing composition.

Other suitable lipophilic fluids include, but are not limited to, diol solvent systems e.g., higher diols such as C6- or C8- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Fluorinert FC-43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco ® canola oil, oleic acid (95% pure, available from Sigma Aldrich Co.) and squalene (99% pure, available from J.T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC-43 (fail) and cyclopentasiloxane (pass). A suitable GC is a Hewlett Packard Gas Chromatograph HP5890 Series II equipped with a split/splitless injector and FID. A suitable column used in determining the amount of lipophilic fluid present is a J&W Scientific capillary column DB-1HT, 30 meter, 0.25 mm id, 0.1 um film thickness cat# 1221131. The GC is suitably operated under the following conditions:

Carrier Gas: Hydrogen

Column Head Pressure: 9 psi

Flows: Column Flow @~1.5 ml/min.
Split Vent @~250–500 ml/min.
Septum Purge @ 1 ml/min.

Injection: HP 7673 Autosampler, 10 ul syringe, 1 ul injection

Injector Temperature: 350° C.

Detector Temperature: 380° C.

Oven Temperature Program: initial 60° C. hold 1 min.
rate 25° C./min.
final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC and DF2000 which are explicitly not covered by the lipophilic fluid definition as used herein. More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Accordingly, the lipophilic fluid of the present invention preferably comprises more than about 50%, more preferably more than about 75%, even more preferably at least about 90%, most preferably at least about 95% by weight of the lipophilic fluid of decamethylcyclopentasiloxane. Alternatively, the lipophilic fluid may comprise siloxanes which are a mixture of cyclic siloxanes having more than about 50%, preferably more than about 75%, more preferably at least about 90%, most preferably at least about 95% up to about 100% by weight of the mixture of decamethylcyclopentasiloxane and less than about 10%, preferably less than about 5%, more preferably less than about 2%, even more preferably less than about 1%, most preferably less than about 0.5% to about 0% by weight of the mixture of octamethylcyclotetrasiloxane and/or dodecamethylcyclohexasiloxane.

The level of lipophilic fluid, when present in the treating compositions according to the present invention, is preferably from about 70% to about 99.99%, more preferably from about 90% to about 99.9%, and even more preferably from about 95% to about 99.8% by weight of the treating composition.

The level of lipophilic fluid, when present in the consumable fabric article treating/cleaning compositions according to the present invention, is preferably from about 0.1% to about 90%, more preferably from about 0.5% to about 75%, and even more preferably from about 1% to about 50% by weight of the consumable fabric article treating/cleaning composition.

Surfactant Component

An optional but highly preferred ingredient in the cleaning compositions and consumable detergent compositions according to the present invention is a surfactant. The surfactant component useful for the present invention is a material that is capable of suspending water in a lipophilic fluid and enhancing soil removal benefits of a lipophilic fluid. The materials may be soluble in the lipophilic fluid.

One class of materials can include siloxane-based surfactants (siloxane-based materials). The siloxane-based surfactants in this application may be siloxane polymers for other applications. The siloxane-based surfactants typically have a weight average molecular weight from 500 to 20,000. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Suitable siloxane-based surfactants comprise a polyether siloxane having the formula:

$$M_aD_bD'_cD''_dM'_{2-a}$$

wherein a is 0–2; b is 0–1000; c is 0–50; d is 0–50, provided that a+c+d is at least 1;

M is $R^1{}_{3-e}X_eSiO_{1/2}$ wherein $R^1$ is independently H, or a monovalent hydrocarbon group, X is hydroxyl group, and e is 0 or 1;

M' is $R^2{}_3SiO_{1/2}$ wherein $R^2$ is independently H, a monovalent hydrocarbon group, or $(CH_2)_f$—$(C6H4)_gO$—$(C_2H_4O)_h$—$(C_3H_6O)_i$—$(C_kH_{2k}O)_j$—$R^3$, provided that at least one $R^2$ is $(CH_2)_f$—$(C6H4)_g$ O—$(C_2H_4O)_h$—$(C_3H_{2k}O)_i$—$(C_kH_{2k}O)_j$—$R^3$, wherein $R^3$ is independently H, a monovalent hydrocarbon group or an alkoxy group, f is 1–10, g is 0 or 1, h is 1–50, i is 0–50, j is 0–50, k is 4–8;

D is $R^4{}_2SiO_{2/2}$ wherein $R^4$ is independently H or a monovalent hydrocarbon group;

D' is $R^5{}_2SiO_{2/2}$ wherein $R^5$ is independently $R^2$ provided that at least one $R^5$ is $(CH_2)_f$—$(C6H4)_g$ O—$(C_2H_4O)_h$—$(C_3H_6O)_i$—$(C_kH_{2k}O)_j$—$R^3$, wherein $R^3$ is independently H, a monovalent hydrocarbon group or an alkoxy group, f is 1–10, g is 0 or 1, h is 1–50, i is 0–50, j is 0–50, k is 4–8; and D" is $R^6{}_2SiO_{2/2}$ wherein $R^6$ is independently H, a monovalent hydrocarbon group or $(CH_2)_l(C_6H_4)_m(A)_n$—$[(L)_o$—$(A')_p$—$]_q$—$(L')_rZ(G)_s$, wherein l is 1–10; m is 0 or 1; m is 0–5, o is 0–3; p is 0 or 1; q is 0–10; r is 0–3; s is 0–3;$C_6H_4$ is unsubstituted or substituted with a $C_{1-10}$ alkyl or alkenyl; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphate, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G is an anion or cation such as $H^+$, $Na^+$, $Li^+$, $K^+$, $NH_4{}^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. Nos. 5,676,705, 5,683,977, 5,683,473, and EP-1,092,803A1 (all to Lever Brothers).

Nonlimiting commercially available examples of suitable siloxane-based surfactants are TSF 4446 (ex. General Electric Silicones), XS69-B5476 (ex. General Electric Silicones); Jenamine HSX (ex. DelCon) and Y12147 (ex. OSi Specialties).

A second preferred class of materials suitable for the surfactant component is organic in nature. Preferred materials are organosulfosuccinate surfactants, with carbon chains of from about 6 to about 20 carbon atoms. Most preferred are organosulfosuccinates containing dialkly chains, each with carbon chains of from about 6 to about 20 carbon atoms. Also preferred are chains containing aryl or alkyl aryl, substituted or unsubstituted, branched or linear, saturated or unsaturated groups.

Nonlimiting commercially available examples of suitable organosulfosuccinate surfactants are available under the trade names of Aerosol TO and Aerosol TR-70 (ex. Cytec). Another preferred class of surfactants is nonionic surfactants, especially those having low HLB values. Preferred nonionic surfactants have HLB values of less than about 10, more preferably less than about 7.5, and most preferably less than about 5. Preferred nonionic surfactants also have from about 6–20 carbons in the surfactant chain and from about 1–15 ethylene oxide (EO) and/or propylene oxide (PO) units in the hydrophilic portion of the surfactant (i.e., C6–20 EO/PO 1–15), and preferably nonionic surfactants selected from those within C7–11 EO/PO 1–5 (e.g., C7–11 EO 2.5).

The surfactant component, when present in the fabric article treating compositions of the present invention, preferably comprises from about 0.01% to about 10%, more preferably from about 0.02% to about 5%, even more preferably from about 0.05% to about 2% by weight of the fabric article treating composition.

The surfactant component, when present in the consumable detergent compositions of the present invention, preferably comprises from about 1% to about 99%, more preferably 2% to about 75%, even more preferably from about 5% to about 60% by weight of the consumable detergent composition.

Non-silicone Additive

The non-silicone additive (i.e., materials do not contain an Si atom), when present, which preferably comprises a strongly polar and/or hydrogen-bonding head group, further enhances soil removal by the compositions of the present invention. Examples of the strongly polar and/or hydrogen-bonding head group-containing materials include, but are not limited to alcohols, cationic materials such as cationic surfactants, quaternary surfactants, quaternary ammonium salts such as ammonium chlorides (nonlimiting examples of ammonium chlorides are Arquad materials commercially available from Akzo Nobel) and cationic fabric softening actives, nonionic materials such as nonionic surfactants (i.e., alcohol ethoxylates, polyhydroxy fatty acid amides), gemini surfactants, anionic surfactants, zwitterionic surfactants, carboxylic acids, sulfates, sulphonates, phosphates, phosphonates, and nitrogen containing materials. In one embodiment, non-silicone additives comprise nitrogen containing materials selected from the group consisting of primary, secondary and tertiary amines, diamines, triamines, ethoxylated amines, amine oxides, amides and betaines, a nonlimiting example of a betaines is Schercotaine materials commercially available from Scher Chemicals and mixtures thereof.

In another embodiment embodiment, alkyl chain contains branching that may help lower the melting point.

In yet another embodiment, primary alkylamines comprising from about 6 to about 22 carbon atoms are used. Particularly preferred primary alkylamines are oleylamine (commercially available from Akzo under the trade name Armeen OLD), dodecylamine (commercially available from Akzo under the trade name Armeen 12D), branched $C_{16}$–$C_{22}$ alkylamine (commercially available from Rohm & Haas under the trade name Primene JM-T) and mixtures thereof.

Suitable cationic materials may include quaternary surfactants, which maybe quaternary ammonium compounds. Commercially available agents include Varisoft materials from Goldschmidt.

Additional suitable cationic materials may include conventional fabric softening actives.

Suitable cationic surfactants include, but are not limited to dialkyldimethylammonium salts having the formula:

$$R'R''N^+(CH_3)_2X^-$$

wherein each R' and R" is independently selected from the group consisting of 12–30 C atoms or derived from tallow, coconut oil or soy, X=Cl or Br, Nonlimiting examples include: didodecyldimethylammonium bromide (DDAB), dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT.

In one embodiment, the cationic surfactants comprise the water-soluble quaternary ammonium compounds useful in the present composition having the formula:

$$R_1R_2R_3R_4N^+X^-$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R_4$ should be benzyl.

The typical cationic fabric softening compounds include the water-insoluble quaternary-ammonium fabric softening actives, the most commonly used having been di(long alkylchain)dimethylammonium (C1–C4 alkyl)sulfate or chloride, preferably the methyl sulfate, compounds including the following:

1) di(tallowalkyl)dimethylammonium methyl sulfate (DTDMAMS);
2) di(hydrogenated tallowalkyl)dimethylammonium methyl sulfate;
3) di(hydrogenated tallowalkyl)dimethylammonium chloride (DTDMAC);
4) distearyldimethylammonium methyl sulfate;
5) dioleyldimethylammonium methyl sulfate;
6) dipalmitylhydroxyethylmethylammonium methyl sulfate;
7) stearylbenzyldimethylammonium methyl sulfate;
8) tallowalkyltrimethylammonium methyl sulfate;
9) (hydrogenated tallowalkyl)trimethylammonium methyl sulfate;
10) ($C_{12-14}$ alkyl)hydroxyethyldimethylammonium methyl sulfate;
11) ($C_{12-18}$ alkyl)di(hydroxyethyl)methylammonium methyl sulfate;
12) di(stearoyloxyethyl)dimethylammonium chloride;
13) di(tallowoyloxyethyl)dimethylammonium methyl sulfate;
14) ditallowalkylimidazolinium methyl sulfate;
15) 1-(2-tallowylamidoethyl)-2-tallowylimidazolinium methyl sulfate; and 16) mixtures thereof.

Suitable nonionic surfactants include, but are not limited to:

a) Polyethylene oxide condensates of nonyl phenol and myristyl alcohol, such as in U.S. Pat No. 4,685,930 Kasprzak; and b) fatty alcohol ethoxylates, R—$(OCH_2CH_2)_a$OH a=1 to 100, typically 12–40, R=hydrocarbon residue 8 to 20 C atoms, typically linear alkyl. Examples polyoxyethylene lauryl ether, with 4 or 23 oxyethylene groups; polyoxyethylene cetyl ether with 2, 10 or 20 oxyethylene groups; polyoxyethylene stearyl ether, with 2, 10, 20, 21 or 100 oxyethylene groups; polyoxyethylene (2), (10) oleyl ether, with 2 or 10 oxyethylene groups. Commercially available examples include, but are not limited to: ALFONIC, BRIJ, GENAPOL, NEODOL, SURFONIC, TRYCOL.

Nonlimiting examples of ethoxylated materials, such as ethoxylated surfactants include compounds having the general formula:

$$R^8—Z—(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is a hydrogen, a carboxylate group, or a sulfate group; and linking group Z is —O—, —C(O)O—, —C(O)N(R)—, or —C(O)N(R)—, and mixtures thereof, in which R, when present, is $R^8$ or hydrogen.

The nonionic surfactants herein are characterized by an HLB (hydrophilic-lipophilic balance) of from 5 to 20, preferably from 6 to 15.

Nonlimiting examples of preferred ethoxylated surfactant are:

straight-chain, primary alcohol ethoxylates, with $R^8$ being $C_8$–$C_{18}$ alkyl and/or alkenyl group, more preferably $C_{10}$–$C_{14}$, and s being from about 2 to about 8, preferably from about 2 to about 6;

straight-chain, secondary alcohol ethoxylates, with $R^8$ being $C_8$–$C_{18}$ alkyl and/or alkenyl, e.g., 3-hexadecyl, 2-octadecyl, 4-eicosanyl, and 5-eicosanyl, and s being from about 2 to about 10;

alkyl phenol ethoxylates wherein the alkyl phenols having an alkyl or alkenyl group containing from 3 to 20 carbon atoms in a primary, secondary or branched chain configuration, preferably from 6 to 12 carbon atoms, and s is from about 2 to about 12, preferably from about 2 to about 8;

branched chain alcohol ethoxylates, wherein branched chain primary and secondary alcohols (or Guerbet alcohols) which are available, e.g., from the well-known "OXO" process or modification thereof are ethoxylated.

Especially preferred are alkyl ethoxylate surfactants with each $R^8$ being $C_8$–$C_{16}$ straight chain and/or branch chain alkyl and the number of ethyleneoxy groups s being from about 2 to about 6, preferably from about 2 to about 4, more preferably with $R^8$ being $C_8$–$C_{15}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91–2.5 ($C_9$–$C_{10}$, s=2.7, HLB=8.5), Neodol 23-3 ($C_{12}$–$C_{13}$, s=2.9, HLB=7.9) and Neodol 25-3 ($C_{12}$–$C_{15}$, s=2.8, HLB=7.5.

Further nonlimiting examples include nonionic surfactants selected from the group consisting of fatty acid ($C_{12-18}$) esters of ethoxylated ($EO_{5-100}$) sorbitans. More preferably said surfactant is selected from the group consisting of mixtures of laurate esters of sorbitol and sorbitol anhydrides; mixtures of stearate esters of sorbitol and sorbitol anhydrides; and mixtures of oleate esters of sorbitol and sorbitol anhydrides. Even more preferably said surfactant is selected from the group consisting of Polysorbate 20, which is a mixture of laurate esters of sorbitol and sorbitol anhydrides consisting predominantly of the monoester, condensed with about 20 moles of ethylene oxide; Polysorbate 60 which is a mixture of stearate esters of sorbitol and sorbitol anhydride, consisting predominantly of the monoester, condensed with about 20 moles of ethylene oxide; Polysorbate 80 which is a mixture of oleate esters of sorbitol and sorbitol anhydrides, consisting predominantly of the monoester, condensed with about 20 moles of ethylene oxide; and mixtures thereof. Most preferably, said surfactant is Polysorbate 60.

Other examples of ethoxylated surfactant include carboxylated alcohol ethoxylate, also known as ether carboxylate, with $R^8$ having from about 12 to about 16 carbon atoms and s being from about 5 to about 13; ethoxylated quaternary ammonium surfactants, such as PEG-5 cocomonium methosulfate, PEG-15 cocomonium chloride, PEG-15 oleammonium chloride and bis (polyethoxyethanol)tallow ammonium chloride.

Other suitable nonionic ethoxylated surfactants are ethoxylated alkyl amines derived from the condensation of ethylene oxide with hydrophobic alkyl amines, with $R^8$ having from about 8 to about 22 carbon atoms and s being from about 3 to about 30.

Also suitable nonionic ethoxylated surfactants for use herein are alkylpolysaccharides which are disclosed in U.S. Pat. No. 4,565,647, Llenado, issued Jan. 21, 1986, having a hydrophobic group containing from about 8 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. The intersaccharide bonds can be, e.g., between the one position of the additional saccharide units and the 2-, 3-, 4-, and/or 6-positions on the preceding saccharide units. The preferred alkylpolyglycosides have the formula:

$$R^2O(C_nH_{2n}O)t(glycosyl)_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

In one embodiment, the nonionic surfactants comprise polyhydroxy fatty acid amide surfactants of the formula:

$$R^2—C(O)—N(R^1)—Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

In one embodiment, the anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein.

These and other surfactants suitable for use in combination with the lipophilic fluid as adjuncts are well known in the art, being described in more detail in Kirk Othmer's Encyclopedia of Chemical Technology, 3rd Ed., Vol. 22, pp. 360–379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference.

The non-silicone additive, when present in the fabric article treating compositions of the present invention, preferably comprises from about 0.001% to about 10%, more preferably from about 0.02% to about 5%, even more preferably from about 0.05% to about 2% by weight of the fabric article treating composition.

The non-silicone additive, when present in the consumable detergent compositions of the present invention, preferably comprises from about 1% to about 90%, more preferably from about 2% to about 75%, even more preferably from about 5% to about 60% by weight of the consumable detergent composition.

Polar Solvent

Compositions according to the present invention may further comprise a polar solvent. Non-limiting examples of polar solvents include: water, alcohols, glycols, polyglycols, ethers, carbonates, dibasic esters, ketones, other oxygenated solvents, and mixutures thereof. Further examples of alcohols include: C1–C126 alcohols, such as propanol, ethanol, isopropyl alcohol, etc . . . , benzyl alcohol, and diols such as 1,2-hexanediol. The Dowanol series by Dow Chemical are examples of glycols and polyglycols useful in the present invention, such as Dowanol TPM, TPnP, DPnB, DPnP, TPnB, PPh, DPM, DPMA, DB, and others. Further examples include propylene glycol, butylene glycol, polybutylene glycol and more hydrophobic glycols. Examples of carbonate solvents are ethylene, propylene and butylene carbonantes such as those available under the Jeffsol tradename. Polar solvents for the present invention can be further identified through their dispersive, ($\square_D$), polar ($\square_P$) and hydrogen bonding ($\square_H$) Hansen solubility parameters. Preferred polar solvents or polar solvent mixtures have fractional polar ($f_P$) and fractional hydrogen bonding ($f_H$) values of $f_P>0.02$ and $f_H>0.10$, where $f_P=\square_p/(\square_D+\square_P+\square_H)$ and $f_H=\square_H/(\square_D+\square_P+\square_H)$, more preferably $f_p>0.05$ and $f_H>0.20$, and most preferrably $f_P>0.07$ and $f_H>0.30$.

In the detergent composition of the present invention, the levels of polar solvent can be from about 0 to about 70%, preferably 1 to 50%, even more preferably 1 to 30% by weight of the detergent composition.

Water, when present in the wash fluid fabric article treating compositions of the present invention, the wash fluid composition may comprise from about 0.001% to about 10%, more preferably from about 0.005% to about 5%, even more preferably from about 0.01% to about 1% by weight of the wash fluid fabric article treating composition.

Water, when present in the detergent compositions of the present invention, preferably comprises from about 1% to about 90%, more preferably from about 2% to about 75%, even more preferably from about 5% to about 40% by weight of the consumable detergent composition.

Processing Aids

Optionally, the compositions of the present invention may further comprise processing aids. Processing aids facilitate the formation of the fabric article treating compositions of the present invention, by maintaining the fluidity and/or homogeneity of the consumable detergent composition, and/or aiding in the dilution process. Processing aids suitable for the present invention are solvents, preferably solvents other than those described above, hydrotropes, and/or surfactants, preferably surfactants other than those described above with respect to the surfactant component. Particularly preferred processing aids are protic solvents such as aliphatic alcohols, diols, triols, etc. and nonionic surfactants such as ethoxylated fatty alcohols.

Processing aids, when present in the fabric article treating compositions of the present invention, preferably comprise from about 0.02% to about 10%, more preferably from about 0.05% to about 10%, even more preferably from about 0.1% to about 10% by weight of the fabric article treating composition.

Processing aids, when present in the consumable detergent compositions of the present invention, preferably comprise from about 1% to about 75%, more preferably from about 5% to about 50% by weight of the consumable detergent composition.

Cleaning Adjuncts

The compositions of the present invention may optionally further comprise one or more other cleaning adjuncts. The optional cleaning adjuncts can vary widely and can be used at widely ranging levels.

Some suitable cleaning adjuncts include, but are not limited to, builders, surfactants, other than those described above with respect to the surfactant component, enzymes, bleach activators, bleach catalysts, bleach boosters, bleaches, alkalinity sources, antibacterial agents, colorants, perfumes, pro-perfumes, finishing aids, lime soap dispersants, odor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

Suitable odor control agents, which may optionally be used as finishing agents, include agents include, cyclodextrins, odor neutralizers, odor blockers and mixtures thereof. Suitable odor neutralizers include aldehydes, flavanoids, metallic salts, water-soluble polymers, zeolites, activated carbon and mixtures thereof.

Perfumes and perfumery ingredients useful in the compositions of the present invention comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes may comprise extremely complex mixtures of such ingredients. Pro-perfumes are also useful in the present invention. Such materials are those precursors or mixtures thereof capable of chemically reacting, e.g., by hydrolysis, to release a perfume, and are described in patents and/or published patent applications to Procter and Gamble, Firmenich, Givaudan and others.

Bleaches, especially oxygen bleaches, are another type of cleaning adjunct suitable for use in the compositions of the present invention. This is especially the case for the activated and catalyzed forms with such bleach activators as nonanoyloxybenzenesulfonate and/or any of its linear or branched higher or lower homologs, and/or tetraacetylethylenediamine and/or any of its derivatives or derivatives of phthaloylimidoperoxycaproic acid (PAP; available from Ausimont SpA under trademane Euroco) or other imido- or amido-substituted bleach activators including the lactam types, or more generally any mixture of hydrophilic and/or hydrophobic bleach activators (especially acyl derivatives including those of the $C_6$–$C_{16}$ substituted oxybenzenesulfonates).

Also suitable are organic or inorganic peracids both including PAP and other than PAP. Suitable organic or inorganic peracids for use herein include, but are not limited to: percarboxylic acids and salts; percarbonic acids and salts; perimidic acids and salts; peroxymonosulfuric acids and salts; persulphates such as monopersulfate; peroxyacids such as diperoxydodecandioic acid (DPDA); magnesium peroxyphthalic acid; perlauric acid; perbenzoic and alkylperbenzoic acids; and mixtures thereof.

Detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. Laundry Additives that are catalytic, for example enzymes, can be used in "forward" or "reverse" modes. For example, a lipolase or other hydrolase may be used, optionally in the presence of alcohols as laundry additives, to convert fatty acids to esters, thereby increasing their solubility in the lipohilic fluid.

Nonlimiting examples of finishing polymers that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

The cleaning adjunct may also be an antistatic agent. Any suitable well-known antistatic agents used in conventional laundering and dry cleaning are suitable for use in the compositions and methods of the present invention. Especially suitable as antistatic agents are the subset of fabric softeners which are known to provide antistatic benefits. For example those fabric softeners that have a fatty acyl group which has an iodine value of above 20, such as N,N-di(tallowoyl-oxy-ethyl)-N,N-dimethyl ammonium methylsulfate. However, it is to be understood that the term antistatic agent is not to be limited to just this subset of fabric softeners and includes all antistatic agents.

Preferred insect and moth repellent cleaning adjuncts useful in the compositions of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the compositions of the present invention are disclosed in U.S. Pat. Nos. 4,449,987; 4,693,890; 4,696,676; 4,933,371; 5,030,660; 5,196,200; and in "Semio Activity of Flavor and Fragrance Molecules on Various Insect Species", B. D. Mookherjee et al., published in *Bioactive Volatile Compounds from Plants*, ACS Symposium Series 525, R. Teranishi, R. G. Buttery, and H. Sugisawa, 1993, pp. 35–48, all of said patents and publications being incorporated herein by reference.

Methods of the Present Invention

The method of the present invention comprises contacting a fabric article in need of cleaning with a silicone-containing polymer. Such methods include processes such as pretreating the fabric article with a consumable detergent composition containing silicone-containing polymer prior to contacting the fabric article with a lipophilic fluid. Another method of the present invention involves contacting fabric articles in need of cleaning with a cleaning composition comprising lipophilic fluid and silicone-containing polymer, preferably in an automatic washing machine.

What is claimed is:

1. A consumable detergent composition comprising silicone-containing polymers functionalized with hydrogen bonding substituents selected from the group consisting of polyol substituents, alkanolamine substituents, and combinations thereof.

2. The consumable detergent composition according to claim 1 wherein said silicone-containing polymer is functionalized with a polyol substituent.

3. The consumable detergent composition according to claim 1 wherein said silicone-containing polymer is further functionalized with at least one optional unit selected from the group consisting of monoamines, monoalcohols, polyalkylene oxides, amides, and combinations thereof.

4. The consumable detergent composition according to claim 1 wherein said silicone-containing polymer is functionalized with a polyol substituent and said composition further comprises a cyclic siloxane lipophilic fluid.

5. A cleaning composition comprising lipophilic fluid and silicone-containing polymers functionalized with hydrogen bonding substituents selected from the group consisting of polyol substituents, alkanolamine substituents, and combinations thereof.

6. A cleaning composition according to claim 5 wherein the lipophilic fluid is D5.

7. A cleaning composition according to claim 6 wherein the silicone-containing polymer is functionalized with a polyol substituent.

8. The cleaning composition according to claim 7 wherein said silicone-containing polymer polymer is further functionalized with at least one optional unit selected from the group consisting of monoamines, monoalcohols, polyalkylene oxides, amides, and combinations thereof.

* * * * *

UNITED STATES PATENT AND TRADEMARK OFFICE

CERTIFICATE OF CORRECTION

PATENT NO. : 6,972,279 B2
APPLICATION NO. : 10/238248
DATED : December 6, 2005
INVENTOR(S) : John Christopher Deak et al.

It is certified that error appears in the above-identified patent and that said Letters Patent is hereby corrected as shown below:

Column 7
Line 53 after the chemical structures, delete "proplyeneoxy" and insert -- propyleneoxy --.
Column 12
Line 30, delete "$(C_3H_{2k}O)$" and insert -- $(C_3H_6O)$ --.
Column 13
Line 15, delete "Aerosol TO" and insert -- Aerosol OT --.
Column 17
Line 67, delete "preferrably" and insert -- preferably --.

Signed and Sealed this

Twenty-ninth Day of April, 2008

JON W. DUDAS
*Director of the United States Patent and Trademark Office*